US006202013B1

(12) United States Patent
Anderson et al.

(10) Patent No.: US 6,202,013 B1
(45) **Date of Patent: *Mar. 13, 2001**

(54) ARTICULATED BOOM MONITORING SYSTEM

(75) Inventors: Thomas M. Anderson, Hugo; Alex Krasny, Eagan; Phil Serre, Chisago; Thomas Eggert, Oakdale; Robert Edwards, Roseville, all of MN (US)

(73) Assignee: Schwing America, Inc., White Bear, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/007,600

(22) Filed: Jan. 15, 1998

(51) Int. Cl.[7] ..... B66C 13/16

(52) U.S. Cl. ..... 701/50; 212/276; 212/301

(58) Field of Search ..... 701/50; 37/348, 37/414; 702/94; 212/276, 277, 278, 279, 280, 281, 294, 301, 302, 304, 306, 195, 196

(56) References Cited

U.S. PATENT DOCUMENTS

| | | | | |
|---|---|---|---|---|
| 3,618,064 | | 11/1971 | Hamilton | 340/267 |
| 3,638,211 | * | 1/1972 | Sanchez | 340/267 |
| 3,819,922 | | 6/1974 | Horn et al. | 235/193 |
| 4,029,213 | * | 6/1977 | Thompson et al. | 212/39 MS |
| 4,052,602 | | 10/1977 | Horn et al. | 364/424 |
| 4,461,369 | * | 7/1984 | Amador | 182/2 |
| 4,532,595 | | 7/1985 | Wilhelm | 364/463 |
| 4,752,012 | | 6/1988 | Juergens | 212/154 |
| 4,833,615 | | 5/1989 | Bitner et al. | 364/463 |
| 4,848,012 | * | 7/1989 | Zimmerman | 37/117.5 |
| 5,058,752 | | 10/1991 | Wacht et al. | 212/150 |
| 5,160,056 | | 11/1992 | Yoshimatsu et al. | 212/155 |
| 5,217,126 | | 6/1993 | Hayashi et al. | 212/153 |
| 5,438,771 | * | 8/1995 | Sahm et al. | 37/348 |
| 5,446,981 | * | 9/1995 | Kamada et al. | 37/348 |
| 5,486,084 | * | 1/1996 | Pitman et al. | 414/694 |
| 5,682,312 | * | 10/1997 | Rocke | 701/50 |
| 5,699,247 | * | 12/1997 | Moriya et al. | 701/50 |
| 5,711,022 | * | 1/1998 | Steenwyk | 701/50 |
| 5,711,440 | * | 1/1998 | Wada | 212/278 |
| 5,746,286 | * | 5/1998 | Mlaker | 182/2.9 |
| 5,823,370 | * | 10/1998 | Ueda | 212/276 |
| 5,862,501 | * | 1/1999 | Talbot et al. | 701/50 |
| 5,907,111 | * | 5/1999 | Jostem et al. | 73/866.5 |
| 5,951,613 | * | 9/1999 | Sahm et al. | 701/50 |
| 6,044,991 | * | 4/2000 | Freudenthal et al. | 212/278 |

* cited by examiner

*Primary Examiner*—Tan Nguyen
(74) *Attorney, Agent, or Firm*—Kinney & Lange, P.A.

(57) ABSTRACT

A monitoring system is provided for monitoring positioning and stability of an articulated boom system The articulated boom system includes an articulated boom, having one or more boom sections, extending from a base, along with one or more outriggers extending from the base. The monitoring system includes a load sensor placed on a leading end of the articulated boom, a boom position sensor placed on the leading end, an outrigger sensor placed on the outrigger(s) and a computer. The load sensor delivers a signal to the computer indicative of the load on the leading end The boom position sensor delivers information to the computer indicative of the position of the leading end with respect to the base. The outrigger sensor delivers a signal to the computer indicative of the extension of the outrigger(s) from the base. The computer determines the position of the articulated boom based upon the sensed position of the leading end. Further, the computer monitors the of the stability of the articulated boom system based upon the sensed load, articulated boom position, outrigger(s) extension and predetermined data.

20 Claims, 4 Drawing Sheets

ARTICULATED BOOM MONITORING SYSTEM

BACKGROUND OF THE INVENTION

The present invention relates to a monitoring system for monitoring operation of an articulated boom. More particularly, it relates to a monitoring system for monitoring position and stability of an articulated boom system which includes a base, an articulated boom and at least one outrigger.

Articulated boom systems are typically used to lift and position loads, such as pumping implements, equipment, work platforms, workers, etc., at particular elevations. For example, in concrete pumping applications, an articulated boom system is used to position a concrete distributing hose at a distant work site, normally located well off of the ground. Similarly, where a construction project requires delivery of concrete along a lengthy, above ground horizontal path, such as tunnel lining, an articulated boom system is used. Even further, articulated boom systems can maneuver the load along a relatively continuous plane. This attribute is important for many material distribution applications where an articulated boom is moved along a ceiling wall, floor, etc. while certain material such as concrete, is distributed. Through recent development, some articulated boom systems have vertical and horizontal ranges on the order of fifty meters. Articulated boom systems normally include a base such as a truck to which an articulated boom with one or more boom sections is attached, a rotational actuator mechanism such as a rack and pinion mechanism for rotating the boom, and outriggers or support legs retractably extending (e.g., by telescoping or pivoting) from the base for stabilizing the articulated boom system. Each boom section has a corresponding actuator which supports the boom section as well as any load supported by that boom section. Typically, the actuators are hydraulic piston/cylinder assemblies. Forces generated by the actuators, lifted loads, or obstacles making contact with the articulated boom, act upon articulated boom components during operation of the articulated boom system. The maximum loads or forces that the actuators, boom sections and other articulated boom system components are structurally designed to withstand are generally known by the articulated boom system manufacturer. This information may be translated into maximum loads or forces that the overall articulated boom system can support or withstand without exceeding design constraints.

Articulated boom System are frequently subjected to work conditions where the articulated boom supports loads and experiences forces that may exceed design limitations. The base serves as a strong support for the articulated boom, allowing movement to a number of positions without tipping. In other words, the articulated boom creates a moment force which is offset by the base. In addition, the outriggers are used to further stabilize the articulated boom system. The outriggers are normally deployed to their fullest extension so as to provide maximum balancing support for the entire articulated boom system. By using outriggers, the articulated boom can be maneuvered to maximize the horizontal and vertical positions without tipping. Typically, a boom operator becomes accustomed to maneuvering the articulated boom to these maximum extension positions, with the outriggers fully deployed.

At times, however, the work site does not allow for full outrigger extension. For example, when working near a heavily used street or along side a hill, one or more of the outriggers may not be able to fully extend or even extend at all. A problem can occur if the boom operator, who is otherwise accustomed to maneuvering the articulated boom to certain vertical and horizontal positions with the outriggers fully extended, forgets that the outriggers are not fully extended and attempts to maneuver the articulated boom to a position he or she has operated at in the past. However, without the extra balancing support provided by the outriggers, the force created by the articulated boom and its attached load becomes too great, causing the entire articulated boom system to tip. In this situation, potentially catastrophic results can occur with harm to human life, nearby facilities, and the articulated boom system itself.

Additional operation safety concerns arise at crowded work sites. Construction work sites often involve a greater number of possible physical obstacles, such as trees, overhead power lines, etc. The boom operator must constantly remain aware of these obstacles whenever present to avoid directing the articulated boom into contact with an obstacle. This may be a demanding task at times due to the location of the obstacle (eg. the exact location of a high power line is difficult to judge), other activities requiring the boom operator's attention, etc. Contact with certain obstacles, such as trees or buildings, may damage the articulated boom system or cause it to tip. Even worse, some obstacles, such as power lines can cause severe injury or death to the operator if contacted. Thus, safe operation of an articulated boom system requires frequent monitoring of the position of the articulated boom along with the location of any obstacles.

Therefore, in view of the above problems associated with articulated boom system operation, a substantial need exists for a monitoring system for monitoring the position and stability of an articulated boom system, and warn or otherwise prevent the articulated boom from moving into a tipping situation, or contacting work site obstacles.

BRIEF SUMMARY OF THE INVENTION

The present invention provides an articulated boom monitoring system for monitoring the position and stability of an articulated boom system. In the preferred embodiment, the monitoring system is based upon sensing a load on a leading end of the boom assembly, the distance (both vertical and horizontal) of the leading end from the base, and the extension, (if any) of various outriggers.

The articulated boom monitoring system of the present invention monitors operation of an articulated boom system having a base from which an articulated boom, having one or more sections, extends, and at least one outrigger attached to the base for stabilizing the articulated boom. The preferred articulated boom monitoring system includes a load sensor, a boom position sensor, an outrigger sensor and a controller. The load sensor is placed on a leading end of the articulated boom for sensing a load and producing a signal representative of the sensed load. Similarly, the boom position sensor senses a position of the leading end of the articulated boom with respect to the base and supplies a boom signal representative of the sensed leading end position. The outrigger sensor senses the extension, if any, of the outrigger from the base and supplies an outrigger position signal representative of the sensed outrigger position. The various signals are received and stored by the controller.

The controller is preprogrammed with information related to operation of the articulated boom system in question. More particularly, the controller is programmed with information related to stability of the articulated boom system at different moments generated by the articulated boom and different outrigger positions. The controller constantly receives the various signals representative of the load on the leading end of the articulated boom and the positions of the articulated boom and the outriggers. The controller uses this information to calculate the actual moment created by the articulated boom on the articulated boom system. The controller then determines whether the base and the outriggers, if any, can support the existing moment created by the articulated boom. In a preferred embodiment, when the controller determines that the boom is moving into a potential hazardous situation (colliding with an obstacle e.g., tipping), a warning signal is delivered.

DETAILED DESCRIPTION OF THE PREFERRED EMBODIMENTS

A. Articulated Boom System 10

Figure 1:
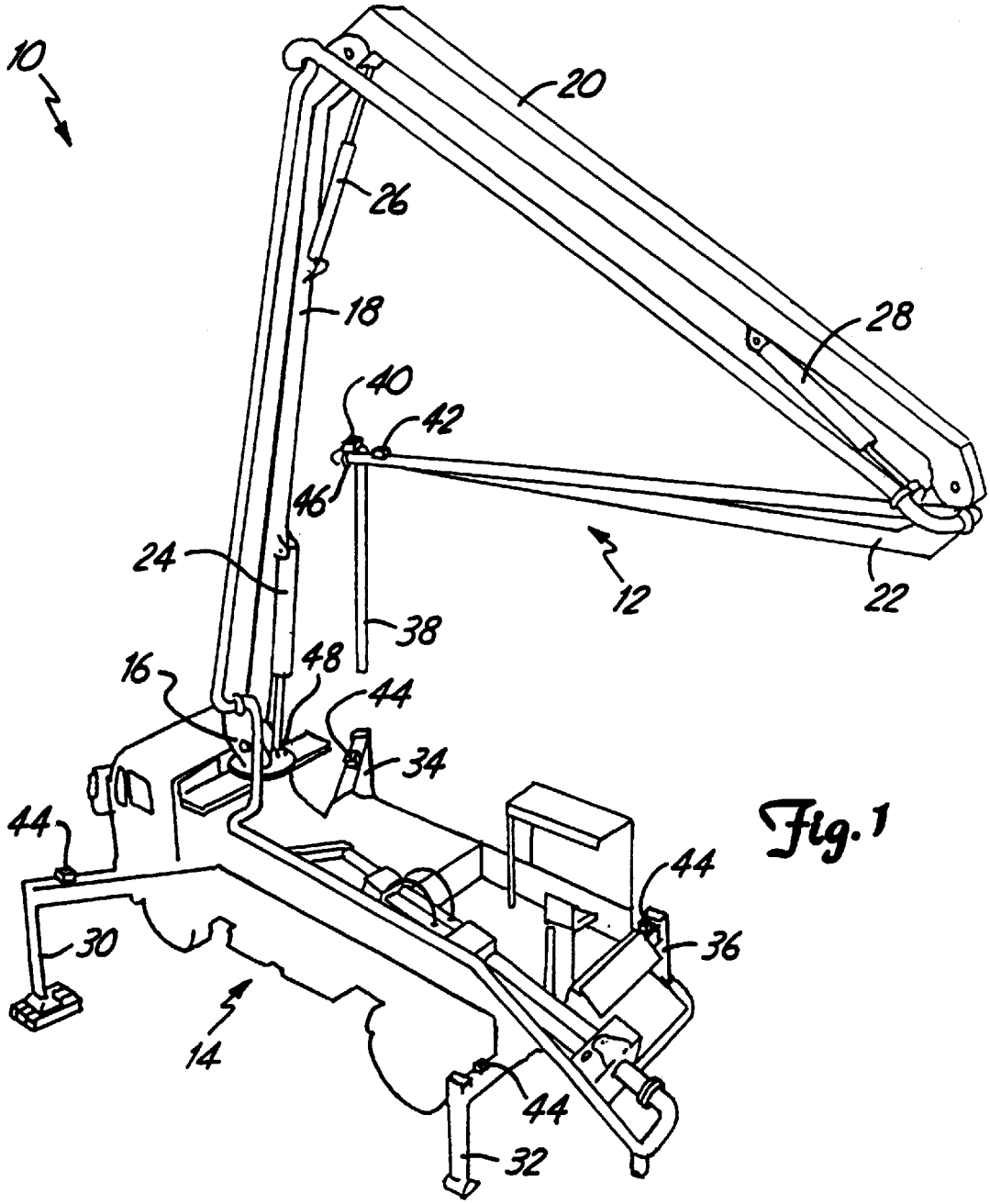
FIG. 1 is a perspective view of an articulated boom system having a monitoring system in accordance with the present invention.

FIG. 1 shows a perspective view of an articulated boom system 10 incorporating a monitoring system of the present invention. The articulated boom system 10 includes an articulated boom 12 and a truck 14. The articulated boom 12 includes a turret 16, a first boom section 18, a second boom section 20, a third boom section 22, a first actuator assembly 24, a second actuator assembly 26 and a third actuator assembly 28. The truck 14 acts as a base and includes hydraulically driven outriggers or support legs 30, 32, 34 and 36 which are used to stabilize the articulated boom system 10 against the weight of the articulated boom 12 and any load carried by the articulated boom 12, such as a hose 38 shown in FIG. 1. In addition to these standard components, the articulated boom system 10 includes a monitoring system some components of which are shown in FIG. 1.

The monitoring system includes a load sensor 40, a boom position sensor 42 and outrigger position (extension) sensor 44. The load sensor 40 is preferably located on a leading end 46 of the articulated boom 12. Similarly, in the preferred embodiment, the boom position or sensor 42 is located on the leading end 46. Finally, each of the outriggers 30, 32, 34 and 36 has an associated outrigger extension sensor 44.

The turret 16 of the articulated boom 12 is mounted on the truck 14 to support the boom sections 18–20 and 22. In preferred embodiments, the turret 16 is rotated by a rotational actuator or drive mechanism such as a rack and pinion mechanism or a motor driven gear mechanism to rotate the articulated boom 12. Although typically the rotational drive mechanism is hydraulically driven, the turret 16 can be rotated by means of other types of drive mechanisms as well.

A bottom end 48 of the first boom section 18 is pivotally connected to the turret 16. A second end of the first boom section 18 is pivotally connected to a fist end of the second boom section 20. Likewise, a second end of the second boom section 20 is pivotally connected to a first end of the third boom section 22, which terminates with the leading end 46. Although in the embodiment shown in FIG. 1 the articulated boom 12 has three boom sections 18–20 and 22, in other preferred embodiment the articulated boom 12 can include any number of boom sections, with a minimum of one boom section. Regardless of the number of boom sections, the leading end 46, as used throughout this specification, is defined as the free end of the last boom section (the third boom section 22 in FIG. 1).

The first actuator assembly 24 is connected to the turret 16 and the first boom section 18 for moving the first boom section 18 relative to the turret 16. The second actuator assembly 26 is connected to the first boom section 18 and the second boom section 20 for moving the second boom section 20 relative to the first boom section 18. Similarly, the third actuator assembly 28 is connected to the second boom section 20 and the third boom section 22 for moving the third boom section 22 relative to the second boom section 20.

In preferred embodiments, the articulated boom 12 is a hydraulic boom system and actuator assemblies 24–26 and 28 are hydraulic actuator assemblies. For example, in the preferred embodiments shown in FIG. 1, the articulated boom 12 is a hydraulic boom and the actuator assemblies 24, 26 and 28 are hydraulic piston/cylinder assemblies. However, it should be noted that the actuator assemblies 24, 26 and 28 can be any other type capable of producing mechanical energy for exerting forces sufficient to support loads on the boom sections 18, 20 and 22 and for making the boom sections 18, 20 and 22 move relative to one another and relative to the turret 16. Thus, the actuator assemblies 24, 26 and 28 can be a type of hydraulic actuator other than a piston/cylinder assembly. Also, the actuator assemblies 24, 26 and 28 can be pneumatic, electrical, or other types of actuators instead of being hydraulic actuators.

The load sensor 40 is positioned on the leading end 46 of the articulated boom 12. The load sensor 40 can be a strain gauge which measures the weight or load placed on the leading end 46. Alternatively, other load sensors are equally applicable, such as a pressure sensor placed on the third actuator assembly 28. Based upon known information, including the length and weight of the third boom section 22, the sensed pressure within the third actuator assembly 28 can be used to calculate the overall load on the leading end 46.

Similar to the load sensor 40, the boom position sensor 42 is located on the leading end 46 of the articulated boom 12. The boom position sensor 42 provides accurate information regarding the position of the leading end 46 with respect to the bottom end 48 of the first boom section 18, or the truck 14. In a preferred embodiment, the boom position sensor 42 is a Global Positioning System (GPS) system (which preferably operates in a differential mode) to achieve high precision position measurement. GPS was designed by the Department of Defense to fulfill precise military navigational requirements. The system consists of twenty-four artificial satellites in orbit 11,000 miles above the earth. A GPS receiver receives a signal from the satellites and through a series of calculations, the GPS system measures the exact distance between the satellites and the GPS receiver. Using the distance from the satellite to the receiver and knowing the exact position of the satellite, the ground position can then be determined by trigonometrically intersecting the distances from a minimum of four satellites simultaneously. The potential for GPS technology is limitless. The accuracy is becoming very precise on the order of 1–2 centimeters (0.39–0.78 inches), in a differential sensing mode. On slow moving equipment, accuracy is increased. The slower the movement of the GPS sensor 42, the more accurate the position can be measured.

The outrigger extension sensors 44 sense a parameter related to the actual extension of each of the outriggers 30, 32, 34 and 36. For example, where the outriggers 30–36 are hydraulically controlled, the outrigger extension sensors 44 are preferably pressure sensors which sense hydraulic pressure in the hydraulic cylinder of each of the outriggers 30–36. The pressure in a particular outrigger hydraulic cylinder is indicative of the total extension of that outrigger 30–36. Alternatively, each outrigger extension sensor 44 can sense the angle that its respective outrigger 30–36 is pivoted away from the truck 14 and, with the overall length of the outrigger 30–36 being known, provides a parameter which is indicative of the overall outrigger extension. In still another embodiment in which telescoping outriggers are used, outrigger sensor 44 can sense linear movement of the outrigger to determine outrigger position or extension. Preferably, the number of outrigger extension sensors 44 will coincide with the number of the outriggers. Thus, when only one outrigger is present, only one outrigger sensor 44 is required.

The above mentioned sensors 40, 42, 44 all provide information directed to stability of the articulated boom system 10, which is a function of a moment force imparted on the truck 14. The moment created by the articulated boom 12 is basically a function of the load on the leading end 46, the horizontal and vertical position of the leading end 46 with respect to the truck 14, and the weight and position of the first boom section 18, the second boom section 20 and third boom section 22. Therefore, the moment generated by the articulated boom 12 varies depending upon the location of the leading end 46 with respect to the truck 14. Given the fact that modern articulated booms can reach vertical heights and horizontal lengths of fifty meters, the moment generated by the articulated boom 12 can vary immensely, regardless of the load on the leading end 46.

The weight of the truck 14 acts as a balancing force or ballast to the moment created by the articulated boom 12. When the turret 16 is attached to a front portion of the truck 14 (as shown in FIG. 1), the truck 14 itself provides a greater balancing force when the leading end 46 is positioned directly in front of or directly behind the truck 14. Conversely, the truck 14 provides less of a ballast when the article boom 12, and therefore the leading end 46, is rotated to either side of the truck 14. In other words, the weight of the truck 14 is such that a greater moment can be accommodated (and thus a greater articulated boom 12 extension) when applied either directly in front of or behind the truck 14.

To provide further balancing support to the truck 14, the outriggers 30–36 are utilized. The outriggers 30–36 add a wider base of support to the truck 14. Further, the outriggers 30–36 stabilize the truck 14 when the articulated boom 12 is maneuvered to either side of the truck 14. When deployed, two of the outriggers 30, 32 act to prevent tipping when the leading end 46, and therefore the moment created by the articulated boom 12, is to the left of the truck (as shown in FIGS. 1) while the other two outriggers 34, 36 act to prevent tipping when the leading end 46 is positioned to the right of the truck 14 (as shown in FIG. 1). Moreover the ourigger 30–36 end from the truck 14, the greater the support provided.

As system 10 is prepared for operation, truck 14 must be leveled. Preferably, truck 14 is leveled to within 3° or less of horizontal using they hydraulicly movable fact of outriggers 30, 32, 34 and 36 to raise or lower corners of truck 14 as necessary. Inclinometers may be used, for example, to aid in the operator in the leveling process.

With parameters related to the load, boom position, and outrigger extension(s) values sensed, the overall stability of the articulated boom system 10 can be monitored. Although the present invention is equally applicable to articulated boom systems 10 using actuator assemblies 24–28 other then hydraulic piston/cylinder assembles, for ease of illustration, the descriptions of preferred embodiments are sometimes limited to booms with hydraulic piston/cylinder actuator assemblies. However, this is not intended to limit the present invention to articulated boom systems 10 with hydraulic piston/cylinder actuators 24–28.

B. Monitoring System 100

Figure 2:
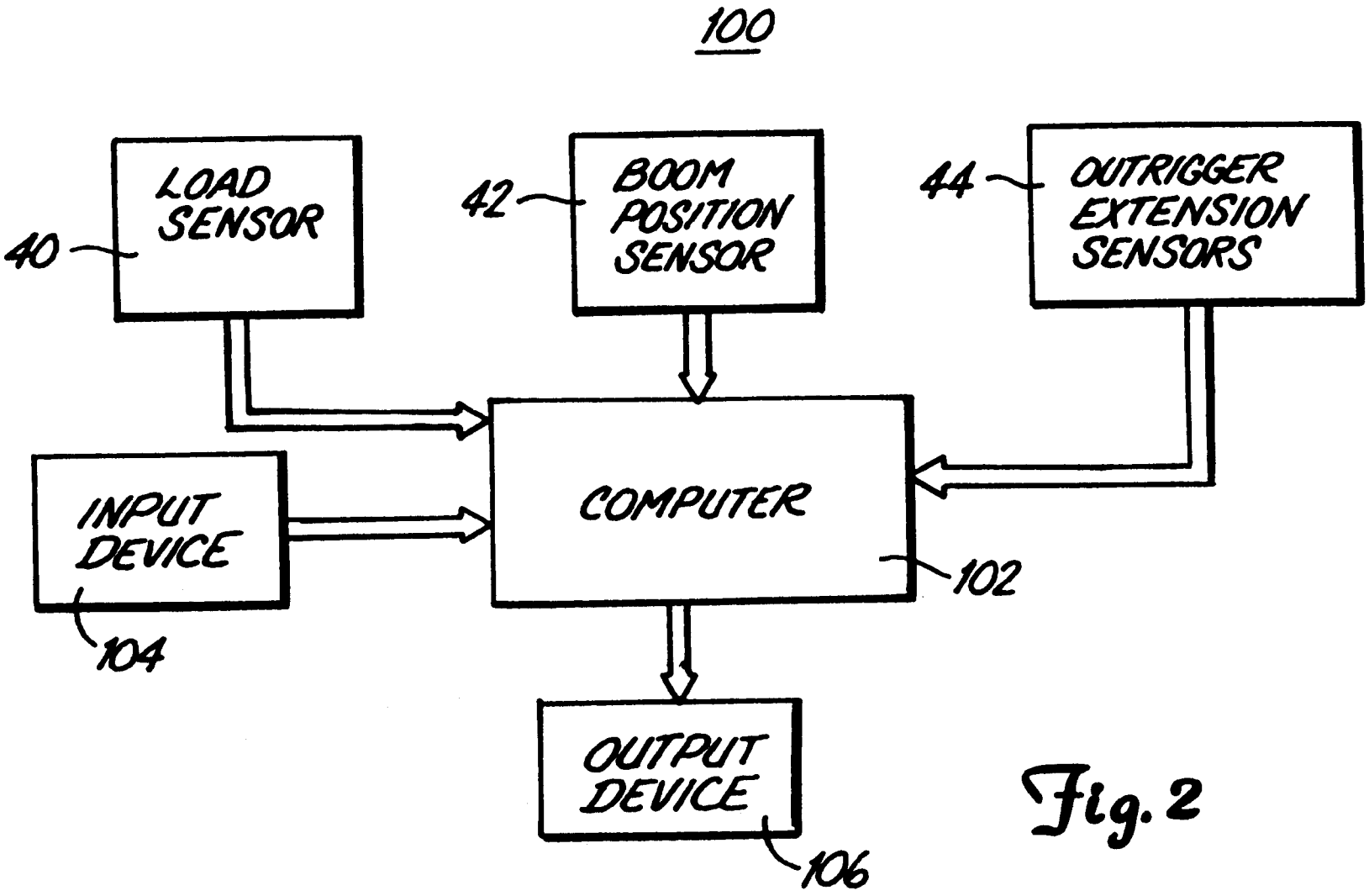
FIG. 2 is a block diagram of a monitoring system for an articulated boom system in accordance with the present invention.

FIG. 2 shows a preferred embodiment of the monitoring system 100. The monitoring system 100 monitors the operation and overall stability of the articulated boom system 10 and warns a user of possible tipping situations. The monitoring system 100 includes the load sensor 40, the boom position sensor 42, the outrigger extension sensors 44, a computer 102, an input device 104 and an output device 106. The load sensor 40, the boom position sensor 42, the outrigger extension sensors 44, the input device 104 and the output device 106 are all connected to the computer 102.

As previously described, the load sensor 40 sense the load on the leading end 46 of the articulated boom 12 (shown in FIG. 1) and provides a signal to the computer 102 which is indicative of this load. The boom position nor 42 senses the vertical and horizontal location of the leading end 46 (shown in FIG. 1) and provides a signal to the computer 102 which is indicative of this position. Finally, the outrigger extension sensors 44 monitor the extension (position) of each of the outrigger 30–36 (shown in FIG. 1) and provide signals to the computer 102 which are indicative of these extensions.

In preferred embodiments, the computer 102 is a microprocessor-based computer including associated memory and associated input/output circuitry. However, in other embodiments, the computer 102 can be replaced with a programmable logic controller (PLC) or other controller or equivalent circuitry.

The input device 104 can also take a variety of forms. In one preferred embodiment, the input device 104 is a keypad entry device. The input device 104 can also be a keyboard, a remote program device, a joystick, or any other suitable mechanism for providing information to the computer 102.

The output device 106 is preferably any of a number of devices. For example, the output device 106 can include a display output such as a cathode ray tube or a liquid crystal display. The output device 106 can also be an alarm device, such as a bell, flashing light etc., which acts to warn an operator of a potential tipping situation. Finally, the output 106 can be a device designed to "shut down" the articulated boom 12 (shown in FIG. 1) and prevent it from maneuvering into a tipping position. In this situation, the output 106 can be an hydraulic control circuit which prevents any of the actuator assemblies 24–28 (shown in FIG. 1) from maneuvering until overridden by the operator.

In preferred embodiments of the present invention, one or more predetermined maximum allowable moment values are stored in the memory of the computer 102. This predetermined data is related to the operating parameters of the particular articulated boom system 10. More particularly, the predetermined data details the acceptable loads (or moments) that can be created by the articulated boom 12 without causing the articulated boom system 10 to tip. As previously described, with respect to FIG. 1, the articulated boom system 10 will tip when the moment applied by the articulated boom 12 exceeds the stabilizing support of the truck 14 and the outriggers 30–36. Therefore, based upon the known support provided by outriggers 30–36, predetermined data regarding the maximum supportable moment at any position of the articulated boom 12 with respect to the truck 14 can be calculated and entered into the computer 102. In other words, for a particular articulated boom system 10, the truck 14 has a general known weight and size. Further, the outriggers 30–36 are of a known size and extend from the truck 14 to known positions. With this information, it is possible to calculate the maximum force the truck 14 and outriggers 30–36 can offset when applied by the artic boom 12 at the turret 16. Notably, this maximum allowable moment will change depending upon the position of the leading end 46, and thus the direction of the moment created by the articulated boom 12.

Depending upon the positioning of the outriggers 30–36, the truck 14 and the outriggers 30–36 may support a larger load centered toward the front of the truck 14 versus a load centered on either side of the truck 14. In this way, maximum supportable moment forces are preferably calculated for a number of rotational positions (approximately every 5 degrees) of the turret 16. To simplify these calculations, it can be assumed that the support provided by the fully extended outrigger 30–36 is virtually identical for any position of the turret 16 and thus the articulated boom 12, therefore requiring only a single maximum allowable moment calculation.

In addition to maximum allowable moment data for various rotational positions of the turret 16 with fully extended outriggers 30–36, predetermined data regarding the maximum allowable moment when the outriggers 30–36 are less than fully extended are also calculated and entered into the computer 102. As previously described, the outriggers 30–36 act to stabilize the articulated boom system 10. As the outriggers 30–36 extend further from the truck 14, they provide more ballast or support to the articulated beam system 10 (depending upon the position of the leading end 46).

Optimally, it is desirable to determine the maximum allowable moment for any position of any of the outriggers 30–36. However, for purposes of simplicity, only the maximum allowable moment at various positions of the turret 16 need to be calculated. Preferably, these calculations would be for when the outriggers 30–36 are not extended, extended one-third of their maximum, extended two-thirds of their maximum and fully extended. Notably, these values should be determined for a number of outrigger 30–36 extension configurations. In other words, in addition to determining the maximum allowable moment with all of the outriggers 30–36 fully extended, the maximum allowable moment for different combinations of various extensions for each of the outriggers 30–36 is preferably elevated (i.e., such as when the first outrigger 30 is two-thirds extended while the remaining outriggers 32–36 are fully extended; or when the first outrigger is one-third extended while the remaining outriggers 32–36 are fully extended; etc.). In the preferred embodiment with four outriggers 30–36, there are 256 different position combinations of outrigger 30–36 extension configurations. To simplify the number of calculations even further, the maximum allowable moment values could be calculated for the outriggers 30–36 in only either unextended or fully extended positions.

Alternatively, instead of entering predetermined maximum allowable moment values, the input device 104 can be used to input the formula necessary to calculate the maximum allowable moment values into the computer 102. With those formulas entered, the computer 102 then performs the requisite calculations to ascertain the maximum allowable moments for various outrigger 30–36 extensions.

The predetermined maximum moment values described above may be supplied to the computer 102 through the input device 104, or may be preprogrammed in the memory of the computer 102. The computer 102, which receives signals from the load sensor 40, the boom position sensor 42 and the outrigger extension sensors 44, constantly monitors the load on the leading end 46 of the articulated boom 12 and its position. During the operation, the actual moment created by the articulated boom 12 is a function of the load on the leading end 46, the position of the leading end 46 with respect to the truck 14 and the weight and positions of the boom sections 18–22. Because the weights of the boom sections 18–22 are known, the sensed load and position of the leading end 46 supply all the information necessary to calculate the actual moment created by the articulated boom 12.

To simplify the requisite actual moment calculation, the positions of the various boom sections 18–22 can be assumed generally as a function of the position of the leading end 46, rather than having to be precisely measured. With this assumption, the actual moment calculation is as follows: The overall weight of the articulated boom 12 is known. The load on the leading end 46 is sensed and recorded. The position of the leading end 46 with respect to the turret 16 and therefore the distance between the leading end 46 and the turret 16, is sensed and recorded. Based upon trigonometric relationships, the center of gravity of the articulated boom 12 is assumed to be located halfway along the distance between the leading end 46 and the turret 16. Thus, the actual moment created by the articulated boom sections 18–22 is the overall weight multiplied by the distance the assumed center of gravity is from the turret 16 (in this case, one-half of the sensed distance between the leading end 46 and the turret 16). Similarly, the moment created by the load is the weight multiplied by the distance between the leading end 46 and the turret 16. Therefore, the actual moment created on the turret 16, and thus the truck 14, is calculated by adding the moment created by the weight of the boom sections 18–22 to the moment created by the load.

To monitor stability of the articulated boom assembly 10, the computer 102, based upon the sensed load on the leading end 46 and the position of the leading end 46, calculates the actual moment generated by the articulated boom 12 as described above. The extensions of the outriggers 30–36 are sensed and stored by the computer 102. The computer 102 recalls from its memory the maximum allowable moment for the current position of the leading end 46, which in the preferred is a function of the rotational position of the turret 16, and the outrigger 30–36 extensions. The computer 102 then compares the maximum allowable moment with the calculated actual moment created by the articulated boom 12. If the actual moment is within a certain percentage of the maximum allowable moment, 10 percent for example the computer 102 sends a warning signal to the output device 106. The warning signal alerts the operator that the articulated boom system 10 is entering into an unstable condition which could result in tipping if the present course is continued. Alternatively, when the actual moment is approaching a tipping situation (ie. nearing the maximum allowable moment), the computer 102 signals the output device 106 to shut down operation of the articulated boom system 10.

C. Articulated Boom System 210

Figure 3:
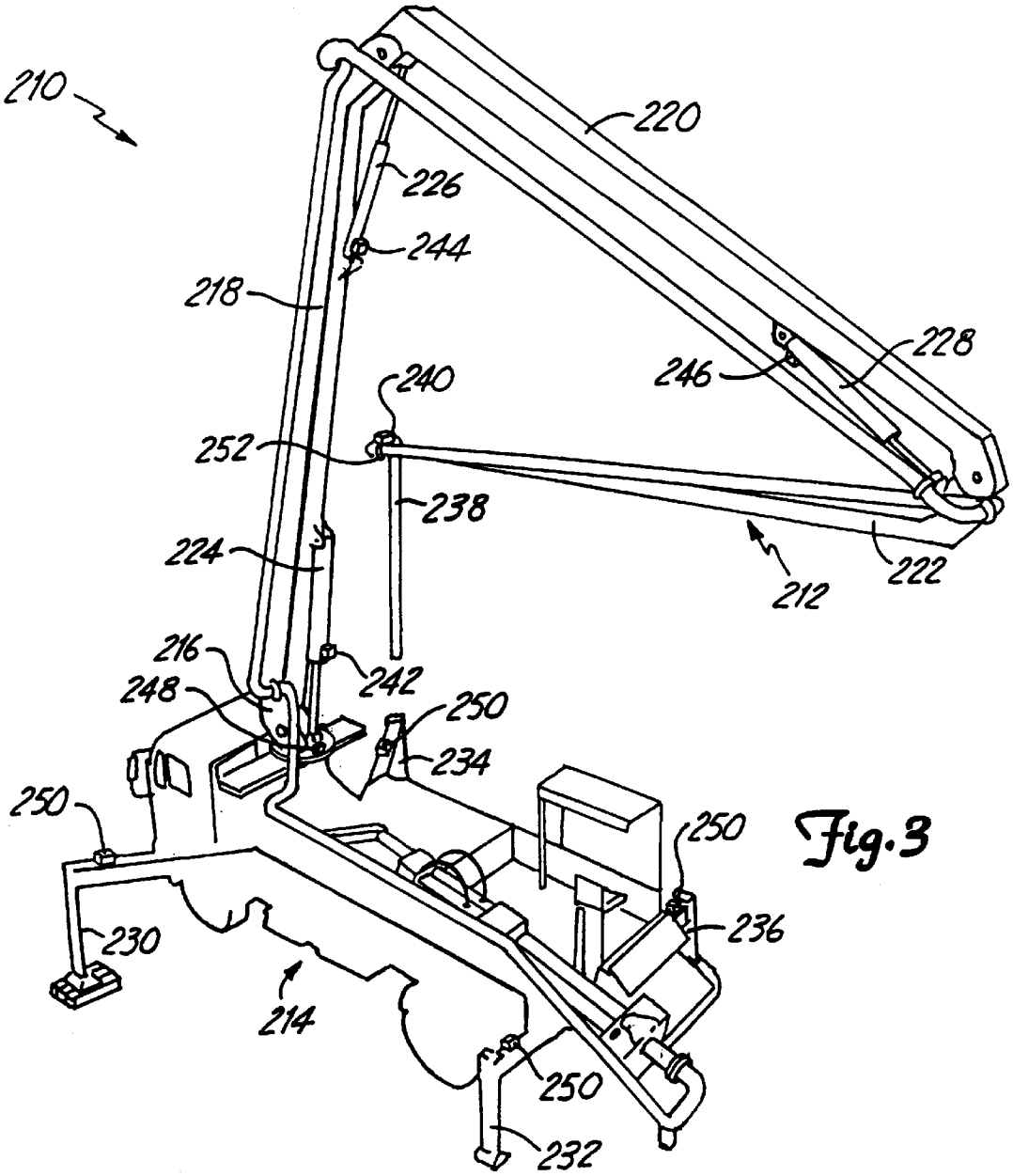
FIG. 3 is a perspective view of an alternative embodiment of an articulated boom system in accordance with the present invention.

An alternative embodiment of an articulated boom system 210 having a monitoring system in accordance with the present invention is shown in FIG. 3. The articulated boom system 210 includes an articulated boom 212 and a truck 214. The articulated boom assembly 212 includes a turret 216, a first boom section 218, a second boom section 220, a third boom section 222, a first actuator assembly 224, a second actuator assembly 226 and a third actuator assembly 228. The truck 214 acts as a base and includes driven outriggers or support legs 230, 232, 234 and 236 which are used to stabilize the articulated boom system 210 against the weight of the articulated boom 212 and any load carried by the articulated boom 212, such as a hose 238 shown in FIG. 3. In addition to these standard components, the articulated boom system 210 includes a monitoring system, some components of which are shown in FIG. 3.

The monitoring system includes a load sensor 240, a first actuator sensor 242 a second actuator sensor 244, a third actuator sensor 246, a rotational sensor 248 and outrigger extension sensors 250. The load sensor 240 is located on a leading end 252 of the articulated boom 212. The first actuator sensor 242 is located on the first actuator assembly 224. The second actuator sensor 244 is located on the second actuator assembly 226. The third actuator sensor 246 is located on the third actuator assembly 228. The rotational sensor 248 is located on the turret 216. Finally each of the outriggers 230–236 has one outrigger extension sensor 250.

The articulated boom system 210 is constructed and operates in a manner similar to that described and shown in FIG. 1. However, the boom position sensor 42 (shown in FIG. 1) is now comprised of the first actuator sensor 242, the second actuator sensor 244, the third actuator sensor 246 and the rotational sensor 248. Each of the actuator sensors 242–246 sense a parameter related to operation of a corresponding one of the actuator assemblies 224–228, which is indicative of a total load supported by each of the actuator assemblies 224–228. The total load supported by each of the actuator assemblies 224–228 can be described in terms of the forces applied by the actuator assemblies 224–228 on the corresponding boom sections 218–222.

Specifically, the first actuator sensor 242 senses a parameter which is indicative of a total load supported by the first actuator assembly 224. The second actuator sensor 244 senses a parameter which is indicative of a total load supported by the second actuator assembly 246. The third actuator sensor 248 senses a parameter which is indicative of a total load supported by the third actuator assembly 228. The total load supported by each of the actuator assemblies 224–228 includes a load component caused by the weight of the boom sections 218–222 themselves as well as a load component caused by the weight of any external load supported by the articulated boom 212, such as the hose 238. Additionally, the total load supported by any one actuator assembly is dependent upon the positions of the boom sections 218–222 relative to one another and upon the position and distribution of the external load supported by the articulated boom 212.

In the alternative embodiment illustrated in FIG. 3, the actuator assemblies 224–228 are hydraulic pistons-cylinder assemblies. Preferably then, the actuator sensors 242–246 are pressure sensors which sense the hydraulic pressure in the hydraulic cylinders of each of the actuator assemblies 224–228. The pressure in a particular hydraulic cylinder is indicative of a total load supported by the corresponding actuator assembly 224–228 and of the forces experienced by the corresponding boom section 218–222.

To determine the position of the leading end 252 of the third boom section 222, the extensions of each actuator assembly 224–228 is sensed. Further, the rotational position of the turret 216 with respect to the truck 214 is similarly sensed by the rotational sensor 248. This data, in conjunction with the known lengths of each of the boom sections 218–222 provides the position of the leading end 252 with respect to the truck 214.

Alternatively, sensors 242, 244 and 246 provide sensor outputs representing the angles between the boom sections. The sensors 242, 244 and 246 may measure, for example, the linear displacement of the piston rod of each actuator, or the angle(s) between the boom sections, or the angle(s) between the actuator and the boom sections.

The load sensor 240 is preferably used to sense the load on the leading end 252 of the articulated boom 212, the value of which is used in the actual moment calculation. However, the above-described sensed positions of each of the boom sections 218–222, the position of the turret 216, the known lengths and weight of the boom sections 218–222 can alternatively be used. In other words, by sensing the rotational position of the turret 216, the angular positions of each of the boom sections 218–222, the known weights and lengths of the boom sections 218–222, the location of the leading end of boom 212 and the center of gravity of boom 212 can be calculated and used to determine the actual moment created by the articulated boom 212 and the load.

Each of the outriggers 230–236 has an outrigger extension (or position) sensor 250. The outrigger extension sensors 250 sense a parameter related to the actual extension (position) of each of the outriggers 230–236. As previously described, where the outriggers 230–236 are hydraulically controlled, the outrigger extension sensors 250 are preferably sensors which sense hydraulic pressure in the hydraulic cylinder in each of the outriggers 230–236. The pressure in a particular outrigger hydraulic cylinder is indicative of the total extension of that outrigger 230–236. Alternative, angle sensors (for pivotable, but triggers) or linear displacement sensors (for telescoping outriggers) can function as sensors 250.

D. Monitoring System 300

Figure 4:
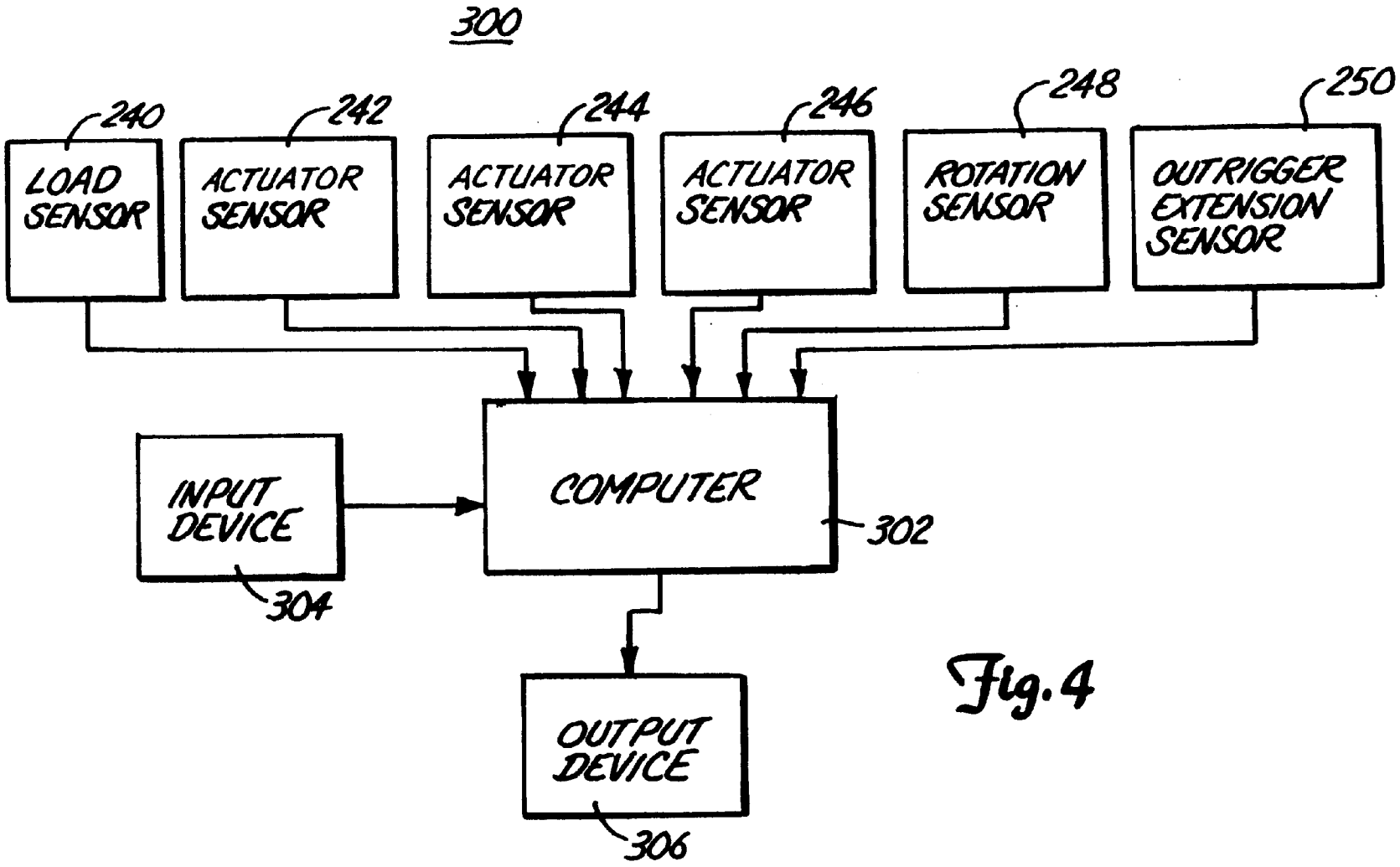
FIG. 4 is a block diagram of an alternative embodiment of a monitoring system for an articulated boom system in accordance with the present invention.

FIG. 4 shows an alternative embodiment of a monitoring system 300 for monitoring the operation of the alternative articulated boom assembly system 210 shown in FIG. 3. The monitoring system 300 includes the load sensor 240, the actuator sensors 242–246, the rotational sensor 248, the outrigger extension sensors 250, a computer 302, an input device 304 and an output device 306. The load sensor 240, the actuator sensors 242–246, the rotational sensor 248, the outrigger extension sensor 250, the input device 304 and the output device 306 are all connected to the computer 302. The computer 302, the input device 304 and the output device 306 are, in preferred embodiments, substantially the same as described in the monitoring system 100 shown in FIG. 2.

As previously described, the load sensor 240 senses a parameter indicative of the total load or force acting on the leading end 252 of the articulated boom 212 (shown in FIG. 3). The actuator sensors 242–246 sense a parameter indicative of the extension, and therefore position, of the boom sections 218–222 (shown in FIG. 3). The rotational sensor 248 senses a parameter indicative of the position of the turret 216 (shown in FIG. 3). The outrigger extension sensors 250 sense parameters indicative of the extension (position) of each of the outriggers 230–236 (shown in FIG. 3). All of the sensors 240–250 provide signals to the computer 302 where they are stored.

One or more predetermined values are stored in the memory of the computer 302. For example, the length of each of the boom sections 218–222 is stored. An equation is also stored in the memory of the computer 302 which, when provided with the angular positions of the boom sections 218–222 as determined by sensors 242–246 and the rotational sensor 248, calculates trigonometrically the position of the leading end 252 with respect to the truck 214.

The monitoring system 300 also has one or more predetermined maximum allowable moment values stored in the memory of the computer 302. This predetermined data is related to the operating parameters of the articulated boom system 210. More particularly, the predetermined data details the maximum allowable moment that can be imparted by the articulated boom 212 on the truck 214 without causing the truck 214 to tip. In a preferred embodiment, the predetermined allowable moment force or tipping data is based upon various outrigger 230–236 extension positions.

During use, the computer 302 constantly monitors, via the sensors 242–246 and the rotational sensor 248, the position of the leading end 252 of the articulated boom 212. Further, the computer 302 constantly monitors the outrigger 230–236 extensions. Whenever the leading end 252 is maneuvered, the computer 302 compares the moment force created by the articulated boom 212 for any new position of the leading end 252 with the predetermined tipping data, which as previously described, is dependent upon the extension, if any, of the outriggers 230–236. When movement of the articulated boom 212 nears a possible tipping situation, the computer 302 sends a warning signal to the output device 306. In a preferred embodiment, the output device 306 then provides an audible or visual warning to an operator. Alternatively, the output device 306 stops the articulated boom 212 from moving into a potentially tipping situation.

E. Conclusion

The present invention provides a new monitoring system which prevents an articulated boom system from moving into a tipping situation. By sensing the position of the leading end of the articulated boom, the actual moment force generated by the articulated boom, the position of any outriggers, and comparing the actual moment to a maximum allowable moment, the monitoring system constantly monitors the stability of the articulated boom system. Further, by using a GPS sensor (or sensors) to ascertain the position of the leading end, the present invention has many other applications. For example, the computer can be programmed with information regarding the actual work site. Where, for example, obstacles such as power lines, trees, etc., might be encountered, the computer can prevent the articulated boom from moving into possible contact with these obstacles. Normally, the location of various obstacles present at a particular site can easily be determined. The location data for each obstacle is entered into the computer. During operation, the computer, via the GPS sensor, constantly compares the position of the articulated boom with the location of all obstacles. Whenever the articulated boom moves too close to an obstacle, for example within three feet, a warning is provided to the operator. Alternatively, the computer will simply prevent the articulated boom from maneuvering within a few feet of any obstacle. Further, GPS sensor data allows operators to ensure precise placement of the leading end of the articulated boom at desired locations.

An additional application is with concrete slab pouring. An articulated boom system is often utilized with the pouring of large concrete slabs in which a continuous supply of concrete is provided by a hose attached to the articulated boom. The concrete supplied by the house must be as uniform as possible so that the resulting slab is flat. This is sometimes difficult due to movement of the boom, and therefore hose, when the supply of concrete begins to slow or when the contours of the area in which the slab is being formed requires the articulated boom to maneuver through various configurations. In any case, the tip of the hose must be maintained at a relatively constant height with respect to the slab to be formed. This constant positioning can be achieved by the monitoring system of the present invention. The monitoring system determines, via the GPS Sensor or other sensor, the height of the hose tip with respect to the slab. This is done by entering the height of the slab with respect to the base of the articulated boom into the computer and comparing that level with the sensed height of the leading end of the articulated boom (and thus the height of the hose tip). Optimally, the leading end of the articulated boom should be maintained within a range of 9 inches to 3 feet above the floor upon which the slab is being made. If the leading end moves out of range, corrective actions will be taken or the system will be shut down.

Although the present invention has been described with reference to preferred embodiments, workers skilled in the art will recognize that changes may be made in form and detail without departing from the spirit and scope of the invention. For example, while a GPS sensor or angle sensors have been described as being used to determine the position of the leading end of the articulated boom, other approaches are equally as acceptable. For example, an electrical wire can be run along the length of the entire articulated boom. The electrical field generated by this wire can be sensed and used to ascertain the position of the leading end with respect to the truck. Alternatively, where the articulated boom is used to direct a hose for pumping applications, such as concrete, magnetic dust can be inserted into the material being pumped. This dust will generate a magnetic field resulting in a "picture" or "trace" of the boom sections which are then sensed and used to determine the position of the leading end.

In yet another embodiment, the boom position sensor can be a laser distance meter. With this configuration, a laser transmitter is positioned on the leading end of the articulated boom and a receiver is positioned on the turret. The transmitter sends out a signal which is received by the receiver. This signal, in conjunction with the rotational position of the turret, is indicative of the position of the leading end of the articulated boom with respect to the truck The preferred embodiments have also been described as utilizing predetermined tipping data for various outrigger extension positions. This can be done for any number of outriggers, and any number of outrigger positions. In other words, the computer can accurately calculate the stabilizing force generated by the outriggers at virtually any outrigger position.

It should also be recognized that several assumptions regarding operation of an articulated boom system can be made which further simplify the various monitoring calculations. For example, because most pumping situations involve approximately the same load on the leading end, this load value can be assumed and used as a constant in the actual moment calculation, thus eliminating the need for the load sensor. Similarly, while the optimum method for determining the actual moment created by the articulated boom includes the weight and position of each of the boom sections, they need not be precisely measured. In other words, the actual moment calculation can assume that the position of each of the boom sections is constant, or is a simple function of the position of the leading end. This constant value is then used in the actual moment calculation. Notably, these assumptions can be made where the specific application is unconcerned with precise moment calculation. When used to obviate potential tipping situations, a precise measurement is unnecessary so long as any assumptions in the various calculations err on the side of safety.

What is claimed is:

1. A monitoring system for monitoring stability of an articulated boom and pipeline concrete placing system, the articulated boom and pipeline system including an articulated boom for supporting the pipeline having a bottom end rotatably connected to a base and a leading end which is maneuverable with respect to the bottom end, the base further including at least one extendable outrigger, the monitoring system comprising:

a boom position sensor, including a global positioning system (GPS) receiver mounted at the leading end of the boom, for providing boom position information from which a horizontal and vertical location of the leading end of the articulated boom can be determined;

an outrigger sensor for sensing a position of the outrigger with respect to the base, wherein the outrigger sensor supplies an outrigger signal representative of the sensed outrigger position; and a controller for receiving the boom position information and the outrigger signal, and for determining stability of the articulated boom assembly based upon the boom position information, the outrigger signal, a known weight of the articulated boom and pipeline, a known weight of the pipeline, and a known weight of a material contained in the pipeline.

2. The monitoring system of claim 1 and further composing:

a load sensor a load on the leading end of the articulated boom, wherein the load sensor supplies a signal to the controller representative of the sensed load.

3. The monitoring system of claim 1, wherein the controller determines an actual moment created by the articulated boom on the base.

4. The monitoring system of claim 3 wherein the controller compares the actual moment created by the articulated boom to a maximum allowable moment.

5. The monitoring system of claim 1, and further comprising:

an output device connected to the controller for generating a warning signal in response to the controller.

6. The monitoring system of claim 5, wherein the warning signal is generated when a moment created by the articulated boom assembly reaches a predetermined level.

7. The monitoring device of claim 1, and further comprising:

an input device connected to the controller for entering information related to a maximum allowable moment on the articulated boom system.

8. A method for monitoring stability of an articulated boom and pipeline concrete dispensing system, the articulated boom and pipeline system including an articulated boom for supporting the pipeline having a plurality of boom sections, the boom having a bottom end rotatably connected to a base and a leading end which is maneuverable with respect to the bottom end, the base further including an outrigger, the method including:

determining a horizontal and vertical position of the leading end of an outermost boom section of the articulated boom with respect to the base by processing information from a global positioning system (GPS) receiver positioned on the leading end;

determining a position of the outrigger with respect to the base; and determining stability of the articulated boom assembly and pipeline based upon the sensed position of the leading end and the sensed position of the outrigger.

9. The method for monitoring stability of claim 8, further including:

determining a load on the leading end of the articulated boom.

10. The method for monitoring stability of claim 9, wherein determining stability includes:

determining an actual moment created by the articulated boom; and comparing the actual moment to a maximum allowable moment.

11. The method for monitoring stability of claim 10, wherein determining an actual moment of the articulated boom is a function of the load and the position of the leading end.

12. The method for monitoring stability of claim 10, and further including:

receiving information related to a maximum allowable moment.

13. The method for monitoring stability of claim 12, and further including:

determining a maximum allowable moment based upon the received information, the position of the leading end and the position of the outrigger.

14. The method for monitoring stability of claim 8, wherein determining stability includes:

determining an actual moment created by the articulated boom as a function of the position of the leading end; and comparing the actual moment to the maximum allowable moment.

15. The method for monitoring stability of claim 8, further including:

delivering a warning signal based upon the determined stability.

16. A method of controlling an articulated boom and pipeline concrete conveying system at a work site, the articulated boom and pipeline system including an articulated boom for supporting the pipeline having a plurality of boom sections movably coupled by a plurality of actuators, the boom having a bottom end rotatably connected to a base and a leading end which is maneuverable with respect to the bottom end, the method including:

storing obstacle location data related to location of an obstacle at the work site;

determining a horizontal and vertical position of the leading end of the articulated boom by processing information from a global positioning system (GPS) receiver positioned on the leading end; and controlling movement of the articulated boom as a function of the sensed horizontal and vertical position of the leading end and the stored obstacle location data to prevent a collision between the articulated boom and the obstacle.

17. The method for controlling of claim 16, wherein controlling the position of the articulated boom includes:

comparing the sensed horizontal and vertical position of the leading end with the obstacle location data of the obstacle at the work site; and stopping movement of the articulated boom when the sensed position of the leading end is within a predetermined distance of the location of the obstacle indicated by the obstacle location data.

18. A method of controlling an articulated boom system delivering concrete to a floor for forming a slab, the articulated boom system having a boom with a bottom end rotatably connected to a base and a leading end which is maneuverable with respect to the bottom end, and a delivery hose connected to the boom for delivering concrete from a supply source, the delivery hose including a tip located at the leading end of the boom, the method including:

storing elevation data related to elevation of the floor;

sensing a height of the leading end by processing information from a global positioning system (GPS) receiver positioned on the leading end; and controlling a position of the boom as a function of the sensed height of the leading end and the stored elevation data.

19. The method of controlling of claim 18, wherein controlling the position of the boom includes:

comparing the sensed height of the leading end with the stored location of the floor, and repositioning movement of the boom with respect to the floor when the sensed height of the leading end is outside of a predetermined distance from the floor.

20. The method of controlling of claim 19, wherein the predetermined distance is a range of 9 inches to 3 feet.

* * * * *